United States Patent [19]

Handa

[11] Patent Number: 4,904,447

[45] Date of Patent: Feb. 27, 1990

[54] LOW THERMAL EXPANSION CASTING ALLOY HAVING EXCELLENT MACHINABILITY

[75] Inventor: Takuo Handa, Kanagawa, Japan

[73] Assignee: Nippon Chuzo Kabushiki Kaisha, Kanagawa, Japan

[21] Appl. No.: 201,088

[22] Filed: Jun. 1, 1988

[51] Int. Cl.[4] ..... C22C 38/08

[52] U.S. Cl. ..... 420/95; 148/336; 420/94

[58] Field of Search ..... 420/94, 95, 581; 148/336, 442

[56] References Cited

FOREIGN PATENT DOCUMENTS

| | | | |
|---|---|---|---|
| 58-126966 | 7/1983 | Japan | 420/95 |
| 58-221225 | 12/1983 | Japan | 420/95 |
| 59-35654 | 2/1984 | Japan | 420/94 |
| 59-116359 | 7/1984 | Japan | 420/95 |
| 60-51547 | 11/1985 | Japan . | |

OTHER PUBLICATIONS

Annual Book of ASTM Standards (1975) Part 2–Ferrous Castings; Ferroalloys American Society for Testing and Materials.

Physics and Application of Invar Alloys (1978), No. 3, Honda Memorial Series on Materials Science No. 3, Maruzen Company, Ltd.

Engineering Properties and Applications of the Ni-Resists and Ductile Ni-Resists.

Metals Handbook, (8th Edition) American Society for Metals.

*Primary Examiner*—Deborah Yee

*Attorney, Agent, or Firm*—Michael N. Meller

[57] ABSTRACT

A low thermal expansion casting alloy which is excellent in machinability, has a reduced thermal expansion coefficient and is suited for use in applications such as precision machine parts. According to a first aspect of the invention, the alloy comprises, in terms of weight percent, C from 0.4% to 0.8%, Ni from 30.0% to 40.0%, and Co from 2.0% to 8.0%, the Ni and Co contents being in the composition range given by the formula $Ni+Co\times0.75=32.0–40.0\%$, the balance being Si 1.0% or less, Mn 1.0% or less S 0.2% or less, P 0.2% or less, one or two or Mg and Ca 0.3% or less in total, unavoidable impurities and iron. According to a second aspect, the alloy of the first aspect is heated to a temperature between 600° and 1000° C. and then quenched. Accordingly to a third aspect, the alloy comprises by weight percent C from 0.6% to 1.4% and Ni from 32.0% to 40.0%, the C and Si contents being in the composition range given by the formula $C+Si\times0.5<1.6\%$, the balance being the same as in the case of the first aspect. According to a fourth aspect, the alloy of the third aspect is heated to a temperature between 600° and 1000° C. and then quenched.

3 Claims, 3 Drawing Sheets

| NO. | TYPE | CUTTING SPEED (m/min.) | | |
|---|---|---|---|---|
| | | 60 | 100 | 200 |
| 5 | INVENTION EXAMPLE |  |  |  |
| 10 | INVER |  |  |  |

| NO. | TYPE | CUTTING SPEED (m/min.) | | |
|---|---|---|---|---|
| | | 60 | 100 | 200 |
| 25 | INVENTION EXAMPLE |  |  |  |
| 30 | INVER |  |  |  |

LOW THERMAL EXPANSION CASTING ALLOY HAVING EXCELLENT MACHINABILITY

BACKGROUND OF THE INVENTION

The present invention relates to a low thermal expansion casting alloy which is excellent in machinability, low in cost and well suited for use in such applications as precision mechanical parts requiring reduced thermal expansion coefficients.

DESCRIPTION OF THE PRIOR ART

Among the practical metal materials heretofore used for the purpose of obtaining low thermal expansion, super-invar and invar (hereinafter referred to as invars) feature that their thermal expansion coefficients are less than 2.0 ppm/°C. in the temperature range between 20° and 100° C. and that they are extremely low in thermal expansion. Since these invars are poor in castability and are shaped by plastic working, the shapes of blank materials supplied are limited to such simple shapes as wires, plates and bars and they are also very poor in machinability.

The unfavorable machinability of the super invar and the invar is considered to reside in the facts that (i) the cutting resistance is increased, (ii) the tool life is reduced, (iii) the chip disposal properties are low, and (iv) the work hardening tends to occur, etc.

While materials obtained by imparting free machinability to the invars by the addition of S, Ca, Pb, Zr, Se, etc., have heretofore been proposed as means of overcoming the foregoing deficiencies, these materials have the disadvantages of deteriorated mechanical properties, increased thermal expansion coefficients and complicated production methods.

On the other hand, the material obtained by imparting castability to the super invar as disclosed in Patent Publication No. 60-51547 and low thermal expansion cast irons containing 36% Ni obtained by similarly imparting castability to the invar, such as, ASTM A-436 Type 5 and ASTM A-439 Type D-5 have overcome the restriction to the blank shapes and have been improved in machinability due to the formation of graphite in the structures in the course of solidification as compared with the super invar and the invar. However, their thermal expansion coefficients are on the order of 4.0 to 6.0 ppm/°C. which are very great as compared with those of the invars and therefore these materials are inadequate for use in applications requiring greater accuracy.

SUMMARY OF THE INVENTION

With a view to overcoming the foregoing deficiencies of the conventional invars, low thermal expansion cast irons, etc., that is (1) the super invar and the invar have the disadvantges of (i) unsatisfactory machinability and (ii) the limited blank shapes, and (2) the low thermal expansion cast irons have high coefficients of thermal expansion, it is the primary object of the invention to provide a low thermal expansion casting alloy which is excellent in all of machinability, thermal expansion and castability.

DETAILED DESCRIPTION OF THE INVENTION

Figure 1:
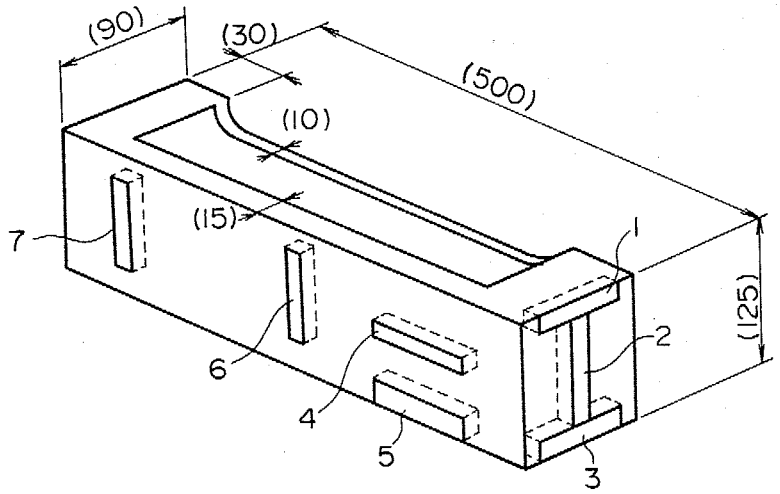
FIG. 1 is an explanatory diagram showing a physical casting shape and test piece sampling positions in various examples.

In either of the previously mentioned invars and low thermal expansion 36% Ni cast irons, the mechanism for lowering of the thermal expansion coefficient can be explained as a phenomenon in which a spontaneous magnetization deformation caused at temperatures lower than the magnetic transformation point is so large that it cancels the thermal vibration of the lattice.

As the result of the studies made by the inventors, etc., on the causes accountable for great differences in thermal expansion coefficient between the invars and the 36% Ni cast irons, it has been found out as follows:

(1) Carbon forms super-saturated solid solution in the base a 36% Ni cast iron and this causes an increase in the external expansion coefficient. Quantitatively, the thermal expansion coefficient is increased by 0.6 ppm/°C. when the solid solution carbon is increased by 0.1% and the thermal expansion coefficient is increased by 0.05 ppm/°C. when graphite volume is increased by 1%.

(2) With such carbon concentration according to the invention, the thermal expansion coefficient is increased by 1.3 ppm/°C. per 1% of Silicon solid solution content.

(3) In the case of the low thermal expansion cast iron, while the machinability is improved as compared with the invars, this is due to the fact that owing to the lubricating action of the graphite present in the structure, the contact resistance between the cast iron and a tool is reduced and moreover the resulting chips do not continue but break.

(4) While the graphite volume percentage of about 1% is sufficient for the machinability, the graphite is present as much as 4 to 7% in the convenient low thermal expansion cast irons thus causing deterioration of the roughness of the finished surface and the external appearance.

(5) In accordance with the carbon concentration of the invention, the coefficient of thermal expansion is reduced by quenching from the temperature of 600° to 1000° C. In other words, if the casting alloy is quenched after it has been heated up to the previously mentioned temperature the carbon present in the form of a supersaturated solid solution in the base is precipitated as fine graphite so that the carbon content of the base is decreased and the micro segregations of nickel and cobalt are relieved, thereby decreasing the thermal expansion coefficient.

In accordance with the invention on the basis of the foregoing findings (1) to (5), the composition range and heat treatment conditions of an alloy having a low thermal expansion characteristic close to those of the invars as well as the equivalent castability and machinability to those of the conventional low thermal expansion cast irons have been discovered.

In other words, excellent machinability and low thermal expansion properties are simultaneously obtained by converting the base structure into the same low carbon austenite as the invars and realizing a condition in which the proper amount of graphite is uniformly distributed in the base structure by a heat treatment and a composition.

In accordance with a first aspect of the invention, there is provided a low thermal expansion casting alloy of excellent machinability which is characterized by comprising, in terms of weight percent, C 0.4% to 0.8%, Si 1.0% or less, Mn 1.0% or less, Ni 30.0 to 40.0%, Co 2.0 to 8.0%, P 0.2% or less, S 0.02% or less, and one or two of Mg and Ca 0.3% or less in total, the Ni and Co contents being in the composition range given by the formula $Ni+Co\times0.75=32.0$ to 40.0%, the balance being iron containing unavoidable impurities.

In accordance with a second aspect of the invention, there is provided a low thermal expansion casting alloy of excellent machinability which is characterized by heating an alloy of the composition according to the first aspect to 600° to 1000° C. and then subjecting to quenching treatment.

In accordance with a third aspect of the invention, there is provided a low thermal expansion casting alloy of excellent machinability which is characterized by comprising in terms of weight percent, C 0.6 to 1.4%, Si 1.0% or less, Mn 1.% or less, Ni 32.0 to 40.0%, S 0.2% or less, P 0.2% or less, and one or two of Mg and Ca 0.3% or less in total, the C and Si contents being in the composition range of the formula $C+Si\times0.5<1.6\%$, the balance being iron containing unavoidable impurities.

In accordance with a fourth aspect of the invention, there is provided a low thermal expansion casting alloy of excellent machinability which is characterized by heating an alloy of the composition of the third aspect to 600° to 1000° C. and then subjecting to quenching treatment.

Next, the reasons for determining the composition limits of these low thermal expansion casting alloys of excellent machinability according to the invention will be described.

C:

If carbon (C) is added in excess of the solid solution limit of the base, the excessive carbon is precipitated as graphite and the machinability is improved.

Since the carbon forms a solid solution of about 0.2% to 0.4% in the base of an alloy of this type, the carbon content exceeding the solid solution limit by a given amount is necessary in order to ensure satisfactory machinability. In addition, the carbon has the function of decreasing the melting point and improving the castability.

In accordance with the first and second aspect, the carbon content of 0.4% or over is necessary to ensure satisfactory machinability and the carbon content of 0.8% or over causes the carbon to start forming a supersaturated solid solution thereby increasing the thermal expansion coefficient and causing a ceiling on the improvement in the machinability. Therefore, the carbon content is selected from 0.4% to below 0.8%.

In accordance with the third and fourth aspect, the carbon content of 0.6% or over is necessry to ensure satisfactory machinability and the carbon content of 1.4% or over causes the carbon to start forming a supersaturated solid solution thereby increasing the thermal expansion coefficient and causing a ceiling on the improvement in the machinability. Therefore, the carbon content is selected from 0.6% to 1.4%.

Si:

While silicon is an element added in view of its action to facilitate the precipitation of graphite and its deoxidation action, the addition of more than 1.0% increases the thermal expansion coefficient to an extent that cannot be ignored and therefore the silicon content is selected 1.0% or less according to all the aspects.

Also, in accordance with the third and fourth aspects of the invention, the following limiting condition for C and Si contents has been found out to enhance the effect of the invention by the examples which will be described later.

$$C+Si\times0.5<1.6\%$$

Even with the above-mentioned composition limits of the C and Si contents, if $C+Si\times0.5$ is over 1.6%, the resulting thermal expansion coefficient is not decreased as compared with the low thermal expansion cast iron.

Mn:

While manganes has the effect of forming a sulfide to fix sulfur, the addition of more than 1.0% causes an increase in the thermal expansion coefficient and therefore its content is selected 1.0% or less in accordance with the respective aspects.

Ni:

Nickel is an essential element, along with the below-mentioned cobalt, for reducing the thermal expansion coefficient and any adjustment of the cobalt content cannot decrease the thermal expansion coefficient as compared with the existing low thermal expansion cast irons if the addition is less than 30.0% in the case of the first and second aspects, less than 32.0% in the case of the third and fourth aspects and more than 40.0% in all the cases. Therefore, the nickel content is selected between 30.0% and 40.0% in the case of the first and second aspects and between 32.0 and 40.0% in the case of the third and fourth aspects.

Co:

Cobalt is added in combination with the above-mentioned nickel since this is preferable for realizing a reduction in the thermal expansion coefficient.

However, the addition of less than 2.0% does not result in any remarkable effect and the addition of over 8.0% conversely increases the thermal expansion coefficient. Thus, the cobalt content is selected between 2.0% and 8.0% in the case of the first and second aspects.

In addition, where there is the coexistence of Ni and Co as in the case of the first and second aspects, from the examples that will be described later it has been found out that the following limiting condition enhances the effect of the invention.

$$Ni+Co\times0.75=32.0-40.0\%$$

Even in the range of the composition limits for the nickel and cobalt contents, the thermal expansion coefficient cannot be reduced as compared with the existing low thermal expansion cast irons if the value of $Ni+Co\times0.75$ is less than 32.0% or more than 40.0%, and therefore the value of the above formula is selected between 32.0% and 40.0% in accordance with the first and second aspects.

P,S:

Phosphorus and sulfur are unavoidably included elements and a remarkable brittleness and the reduced strength are caused when each of them is added 0.2% or over. Thus, their contents are each selected less than 0.2%.

Mg, Ca:

Manganese or calcium is an element which is added for the purpose of spherodizing the graphite when it is necessary to improve the strength and ductility. However, if the total amount of one or two of them is 0.3% or more, the cleanliness is deteriorated and therefore the total amount is selected less than 0.3% according to all the aspects.

The balance is iron containing unavoidable impurities.

Next, the reasons for limiting the heat treating conditions will be described.

If alloys having the compositions as in the case of the first and third phases are heated to a temperature between 600° and 1000° C. and then subjected to quenching treatment, a further reduction in the thermal expansion coefficient is attained thus producing casting alloys having the equivalent thermal expansion coefficients to the invars and excellent machinability.

In other words, by heating such alloy to a high temperature, the carbon contained as a super-saturated solid solution in the matrix during the solidification is precipitated so that simultaneously the carbon concentration in the matrix is decreased and the micro-segregations of cobalt and nickel are lessened.

In order to attain both of these effects, the temperature of less than 600° C. increases the processing time and also fails to reduce the segregations, whereas the temperature of over 1000° C. facilitates the reduction of the segregations but causes the graphite to form a solid solution in the matrix thereby increasing the thermal expansion coefficient. Thus, the heating temperature is selected between 600° and 1000° C. in the case of the second and fourth aspect. Also, if the heating is followed by slow cooling, the reduced segregations are again caused to increase. Thus, the heating is followed by a quenching treatment. This quenching treatment means the cooling by air cooling, oil quenching or water cooling.

With this low thermal expansion casting alloy of excellent machinability according to the invention, its use for the important parts of various precision machines such as machine tools, measuring instruments, semiconductor manufacturing machines and optical machines has the effect of attaining greatly improved accuracy in those field where the low thermal expansion cast iron has been used and a reduced cost in those fields where the invars have been used, and thus this casting alloy produces immeasurable effects on the related fields.

Working examples of the invention will now be described.

EXAMPLE 1

By employing a 30 KVA high frequency furnace, test materials (Φ30 mm×L230 mm) having the chemical compositions shown in the following Table 1 were casted into silica sand molds of the $CO_2$ process and the furan process and JIS No. 4 tensile test pieces and thermal expansion coefficient measuring pieces of Φ7.5 mm×L50 mm were produced. The former pieces were subjected to tensile test at the room temperature and the thermal expansion coefficients of the later pieces at 20° and 100° C. were measured by a thermal expansion meter, thereby obtaining the results shown in Table 1.

However, the commercial invar (forged product) and ASTM A439 Type D-5 were respectively used for No. 10 and No. 11 for purposes of comparison.

As shown in Table 1, the alloy pieces of this invention showed thermal expansion coefficients of less than 4 ppm/°C. in the as-cast conditions and about 3 ppm/°C. after the quenching treatment and No. 5 of the optimum composition showed a thermal expansion coefficient close to that of the invar (No. 10).

In addition, the mechanical properties were the same or better than those of the conventional low thermal expansion cast irons.

The results of Table 2 were obtained by performing heat treatment tests by using the No. 2 test material of Table 1, measuring the resulting thermal expansion coefficients by means of a thermal expansion meter as mentioned previously and examining the relation between the heat treatment condition and the thermal expansion coefficient.

TABLE 1

| | Chemical Composition (wt %) | | | | | | | | | **ppm/°C. | | | Mechanical Properties (quenched) | | | |
|---|---|---|---|---|---|---|---|---|---|---|---|---|---|---|---|---|
| No. | C | Si | Mn | P | S | Ni | Co | Ni + Co × 0.75 | Mg | Ca* | As-cast | Quenched*** | Load at 0.2% Proof Stress Kgf/mm² | Tensile Strength Kgf/mm² | Elongation % | Type |
| 1 | 0.57 | 0.39 | 0.75 | 0.013 | 0.005 | 31.1 | 2.5 | 33.0 | 0.001 | — | 3.6 | 2.9 | 27.3 | 43.9 | 10.8 | Invention |
| 2 | 0.77 | 0.78 | 0.55 | 0.021 | 0.007 | 37.2 | 2.4 | 39.0 | 0.020 | 0.025 | 3.9 | 3.0 | 33.1 | 54.6 | 23.8 | Examples |
| 3 | 0.78 | 0.43 | 0.49 | 0.022 | 0.007 | 33.9 | 7.8 | 39.8 | 0.046 | 0.025 | 3.2 | 2.4 | 31.2 | 50.6 | 26.4 | |
| 4 | 0.69 | 0.53 | 0.48 | 0.025 | 0.005 | 30.8 | 7.2 | 36.2 | 0.055 | — | 3.4 | 2.5 | 30.2 | 49.4 | 21.2 | |
| 5 | 0.72 | 0.63 | 0.23 | 0.020 | 0.009 | 32.3 | 5.2 | 36.2 | 0.035 | 0.025 | 2.6 | 1.5 | 34.1 | 51.9 | 24.0 | |
| 6 | 0.67 | 0.57 | 0.42 | 0.015 | 0.010 | 29.8 | 2.1 | 31.4 | 0.031 | 0.025 | 4.2 | 3.6 | — | — | — | Comparative |
| 7 | 0.74 | 0.67 | 0.51 | 0.019 | 0.008 | 39.4 | 2.5 | 41.3 | 0.002 | — | 5.5 | 4.9 | — | — | — | Examples |
| 8 | 0.80 | 0.83 | 0.79 | 0.020 | 0.008 | 34.0 | 8.2 | 40.2 | 0.041 | 0.025 | 4.0 | 3.4 | — | — | — | |
| 9 | 0.79 | 0.77 | 0.81 | 0.023 | 0.015 | 29.6 | 9.5 | 36.7 | 0.028 | 0.050 | 4.1 | 3.5 | — | — | — | |
| 10 | 0.02 | 0.39 | 0.42 | 0.004 | 0.006 | 36.0 | — | 36.0 | 0.002 | — | | 1.4 | 27.0 | 46.5 | 38.4 | 1 |
| 11 | 2.24 | 2.54 | 0.57 | 0.027 | 0.015 | 35.6 | — | 35.6 | 0.072 | — | 5.2 | 5.1 | 25.8 | 43.4 | 20.3 | 2 |

TABLE 2

| Heating Temperature °C. | Thermal Expansion Coefficient ppm/°C. (Average at 20–100° C.) Furnace quenching | Air quenching | Oil quenching | Water Quenching | Remarks |
|---|---|---|---|---|---|
| 500 | 3.9 | 3.8 | 3.8 | 3.7 | Comparative Example |
| 600 | 3.9 | 3.5 | 3.3 | 3.1 | |
| 750 | 3.8 | 3.4 | 3.2 | 3.0 | |

TABLE 2-continued

| Heating Temperature °C. | Thermal Expansion Coefficient ppm/°C. (Average at 20-100° C.) Furnace quenching | Air quenching | Oil quenching | Water Quenching | Remarks |
|---|---|---|---|---|---|
| 850 | 3.8 | 3.6 | 3.4 | 3.2 | |
| 1000 | 3.9 | 3.8 | 3.7 | 3.5 | |
| 1050 | 4.0 | 3.9 | 3.9 | 3.8 | Comparative Example |
| 1100 | 4.0 | 3.9 | 4.0 | 4.2 | |

From the above Example 1 it has been confirmed that an alloy comprising, in terms of weight percentage, C 0.4% to 0.8%, Si 1.0% or less, Mn 1.0% or less, Ni 30.0 to 40.0%, Co 2.0 to 8.0%, S 0.2% or less, P 0.2% or less, and one or two of Mg and Ca 0.3% or less in total, the nickel and cobalt contents being in the composition range given by the following formula $$Ni+Co\times 0.75=32.0-40.0\%$$

and the balance being iron containing unavoidable impurities, is excellent in mechanical properties and greatly improved in thermal expansion coefficient over the existing low thermal expansion cast irons.

EXAMPLE 2

In accordance with the above-mentioned Example 1, a physical casting shown in FIG. 1 was produced with the composition shown in Table 3 and the heat treatment shown in Table 4 was performed. Then a test piece was cut out from each of the positions shown in FIG. 1 and their thermal expansion coefficients were measured in accordance with Example 1, thereby obtaining the results of Table 5.

TABLE 3

| Chemical Composition of Test Material (wt %) | | | | | | | | |
|---|---|---|---|---|---|---|---|---|
| C | Si | Mn | P | S | Ni | Co | Mg | Ca* |
| 0.69 | 0.58 | 0.31 | 0.022 | 0.010 | 32.0 | 5.1 | 0.038 | 0.025 |

*added amount

TABLE 4

| Heating, Quenching Treatment |
|---|
| 750° C. × 2 hr. → water quenching |

TABLE 5

| Sampling position No. | 1 | 2 | 3 | 4 | 5 | 6 | 7 |
|---|---|---|---|---|---|---|---|
| Thermal expansion coefficient ppm/°C. | 1.2 | 1.4 | 1.4 | 1.2 | 1.1 | 1.3 | 1.3 |

As shown in Table 5, it has been confirmed that the variations in thermal expansion coefficient among the different test piece sampling positions are small and a low thermal expansion coefficient is obtainable in the case of the physical casting of the composition shown in Table 3.

EXAMPLE 3

Using the molten alloys of the test materials No. 5 and No. 11 in Example 1, round castings of Φ100 mm×L400 mm were casted by using a silica sand mold of the furan process and subjected to a machinability test.

Also, as a comparative example, the commercial invar of Φ100 mm×L400 mm having the same composition as the test material No. 10 was tested simultaneously.

The machine and tool used were as follows:

machine: lathe (swing 500 mm, center spacing 1,000 mm)

tool: JIS P20 (superalloy)

Figure 2:
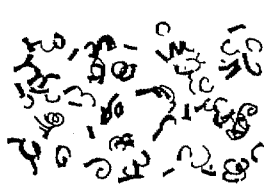
FIGS. 2 and 3 are diagrams showing comparatively the external appearance of chips resulting from the machining of the castings made in the invention examples and comparative examples of Examples 3 and 6.
Figure 2:
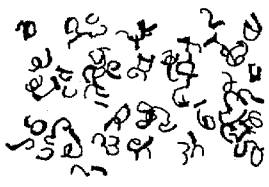
Figure 2:
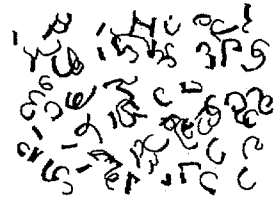
Figure 2:
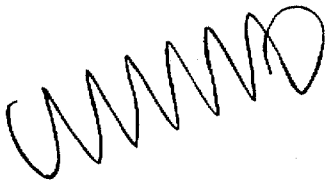
Figure 2:
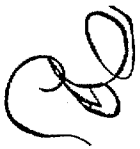
Figure 2:
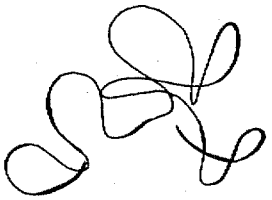

By processing these materials with the conditions of Table 6, the results of Table 7 were obtained with respect to the machinability, chip disposal capacity, work surface roughness and tool life. Also, FIG. 2 shows the external conditions of the chips.

TABLE 6

| Condition | Item: Cutting resistance | Chip disposal capacity | Work surface roughness | Tool life |
|---|---|---|---|---|
| cut depth (mm) | 2.0 | 2.0 | 0.5 | 2.0 |
| Feed (mm/rev) | 0.2 | 0.2 | 0.2 | 0.2 |

TABLE 7

| Measured value | Item: Cutting resistance (60 m/min) Principal component of force | Work surface roughness (100 m/min) R max | Tool life (100 m/min) * | Remarks |
|---|---|---|---|---|
| No. 5 | 102 Kgf | 10.2 μm | 15 minutes | Invention example |
| No. 10 | 127 Kgf | 11.2 μm | 7 minutes | Invar |
| No. 11 | 81 Kgf | 18.0 μm | 42 minutes | ASTM A439 Type D-5 |

*At time of frank wear width of 0.4 mm

From the results of Example 3 it has been confirmed that the alloy of the invention, having the composition and undergoing the heat treatment as mentioned previously, is excellent in machinability as compared with the invars and is considerably improved in work surface roughness as compared with the existing low thermal expansion cast irons.

EXAMPLE 4

As in the case of Example 1, employing a 30 KVA high frequency furnace, test materials (Φ3 mm×L230 mm) of the chemical compositions shown in the following Table 8 were casted into silicon sand molds of the $CO_2$ process and the furan process, and JIS No. 4 tensile test pieces and thermal expansion coefficient measuring pices of Φ7.5 mm×L50 mm were produced. The former pieces were subjected to a tensile test at the room temperature and the thermal expansion coefficients at 20° to 100° C. of the latter pieces were measured by means of a thermal expansion meter, thereby obtaining the results of Table 8.

However, the commercial invar (forged product) and ASTM A439 Type D-5 were respectively used for No. 30 and No. 31 for purposes of comparison.

As shown in Table 8, the alloy pieces of this invention showed thermal expansion coefficients of less than 4 ppm/°C. in the as-cast conditions and about 3 ppm/°C. after the quenching treatment and No. 25 of the optimum composition showed a thermal expansion coefficient close to that of the invar (No. 30).

Moreover, the mechanical properties were the same or better than those of the conventional low thermal expansion cost irons.

From these results it has been conformed that an alloy comprising, in terms of weight percent, C 0.6 to 1.4%, Si 1.0% or less, Mn 1.0% or less, Ni 32.0 to 40.0%, S 0.2% or less, P 0.2% or less, and one or two of Mg and Ca 0.3% or less in total, the C and Si contents being in the composition range given by the following formula $$C+Si\times0.5<1.6\%$$

and the balance being iron containing unavoidable impurities, is excellent in mechanical properties and greatly improved in thermal expansion coefficient over the existing low thermal expansion cast irons.

TABLE 8

| | Chemical Composition (wt %) | | | | | | | | | **ppm/°C. | | Mechanical Properties . . . (quenched) | | | |
|---|---|---|---|---|---|---|---|---|---|---|---|---|---|---|---|
| No. | C | Si | Mn | P | S | Ni | C + Si × 0.5 | Mg | Ca* | As-cast | Quenched *** | Load at 0.2% Proof Stress Kgf/mm² | Tensile Strength Kgf/mm² | Elongation % | Type |
| 21 | 0.64 | 0.31 | 0.51 | 0.018 | 0.009 | 33.4 | 0.80 | 0.002 | — | 3.5 | 2.5 | 25.7 | 40.8 | 9.7 | Invention Examples |
| 22 | 1.32 | 0.36 | 0.49 | 0.021 | 0.013 | 35.9 | 1.50 | 0.018 | 0.035 | 3.8 | 2.7 | 28.8 | 47.6 | 22.5 | |
| 23 | 1.07 | 0.90 | 0.55 | 0.020 | 0.011 | 36.3 | 1.52 | 0.031 | 0.025 | 3.9 | 2.8 | 29.1 | 48.0 | 20.7 | |
| 24 | 0.65 | 0.89 | 0.53 | 0.023 | 0.007 | 38.5 | 1.10 | 0.039 | — | 3.9 | 3.1 | 27.9 | 47.5 | 21.9 | |
| 25 | 0.92 | 0.67 | 0.48 | 0.015 | 0.015 | 36.1 | 1.26 | 0.033 | 0.025 | 3.2 | 2.0 | 28.6 | 49.3 | 24.6 | |
| 26 | 1.53 | 0.37 | 0.60 | 0.020 | 0.008 | 31.2 | 1.72 | 0.027 | 0.025 | 4.6 | 4.2 | — | — | — | Comparative Examples |
| 27 | 1.22 | 1.16 | 0.57 | 0.019 | 0.007 | 39.3 | 1.80 | 0.005 | — | 6.2 | 5.7 | — | — | — | |
| 28 | 0.77 | 1.35 | 0.52 | 0.022 | 0.011 | 41.2 | 1.45 | 0.037 | 0.025 | 6.4 | 5.8 | — | — | — | |
| 29 | 1.20 | 0.87 | 1.41 | 0.018 | 0.016 | 30.5 | 1.64 | 0.022 | 0.050 | 4.5 | 4.0 | — | — | — | |
| 30 | 0.02 | 0.39 | 0.42 | 0.004 | 0.006 | 36.0 | 0.22 | 0.002 | — | | 1.5 | 27.0 | 46.3 | 37.5 | *1 |
| 31 | 2.17 | 2.23 | 0.63 | 0.022 | 0.021 | 35.4 | 3.29 | 0.063 | — | | 5.3 | 25.5 | 44.1 | 18.8 | *2 |

*Added amount
**Thermal expansion coefficient (average value at 20–100° C.)
***750° C. × 1 hr. → water quenching
****Annealed product
*1 Invar
*2 ASTM A439 Type D-5

The results of Table 9 were obtained by performing heat treatment tests by using the No. 22 test material of Table 8, measuring the resulting thermal expansion coefficients by means of a thermal expansion meter as mentioned previously and examining the relation between the heat treatment condition and the thermal expansion coeffficient.

TABLE 9

| Heating Temperature °C. | Thermal Expansion Coefficient ppm/°C. (average at 20–100° C.) Furnace Cooling | Air Cooling | Oil quenching | Water quenching | Remarks |
|---|---|---|---|---|---|
| 500 | 3.9 | 3.9 | 3.9 | 3.8 | Comparative Example |
| 600 | 3.8 | 3.6 | 3.4 | 3.2 | |
| 750 | 3.8 | 3.5 | 3.3 | 3.1 | |
| 850 | 3.9 | 3.6 | 3.5 | 3.3 | |
| 1000 | 4.0 | 3.7 | 3.8 | 3.6 | |
| 1050 | 4.1 | 4.0 | 4.0 | 4.0 | Comparative Example |
| 1100 | 4.0 | 4.7 | 4.2 | 4.3 | Comparative Example |

EXAMPLE 5

In accordance with the above-mentioned Example 1, a physical casting such as shown in FIG. 1 was produced with the composition shown in Table 10 and a heat treatment was performed under the same condition as the heat treatment of Table 4. Then, a test piece was cut out from each of the position shown in FIG. 1 and their thermal expansion coefficients were measured in accordance with Example 1, thereby obtaining the results of Table 11 showing the thermal expansion coefficient distribution of the test piece sampling positions.

TABLE 10

| Chemical Composition of Test Material (wt %) | | | | | | | |
|---|---|---|---|---|---|---|---|
| C | Si | Mn | P | S | Ni | Mg | Ca* |
| 0.82 | 0.60 | 0.20 | 0.014 | 0.009 | 35.7 | 0.075 | 0.020 |

*added amount

TABLE 11

| Sampling position No. | 1 | 2 | 3 | 4 | 5 | 6 | 7 |
|---|---|---|---|---|---|---|---|
| Thermal expansion coefficient ppm/°C. | 1.9 | 2.1 | 2.1 | 1.9 | 1.8 | 2.0 | 2.0 |

As shown in Table 11, it has been confirmed that the variations in thermal expansion coefficient among the different test piece sampling positions are small and a low thermal expansion coefficient is obtainable in the case of the physical casting of the composition shown in Table 10.

EXAMPLE 6

Using the molten alloys of the test materials No. 25 and No. 31 in Example 4, round castings of Φ100 mm×L400 mm were cast by using a silica sand mold of the furan process and subjected to a machinability test.

Also, as a comparative example, the commercial invar of Φ100 mm×L400 mm having the same composition as the test material No. 30 was tested simultaneously.

The same machine and tool as in the case of Example 3 were used and the materials were processed under the conditions of Table 6 for Example 3, thereby obtaining the results of Table 12 with respect to the machinability, chip disposal capacity, work surface roughness and tool life.

TABLE 12

| | Item | | | |
|---|---|---|---|---|
| Measured value | Cutting resistance (60 m/min) Principal component of force | Work surface roughness (100 m/min) R max | Tool life (100 m/min) * | Remarks |
| No. 25 | 96 Kgf | 14.0 μm | 18 minutes | Invention example |
| No. 30 | 127 Kgf | 11.2 μm | 7 minutes | Invar |
| No. 31 | 83 Kgf | 18.5 μm | 40 minutes | ASTM A439 Type D-5 |

*At time of frank wear width of 0.4 mm

Figure 3:
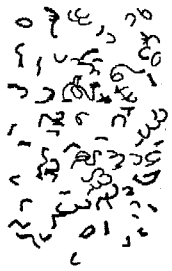
Figure 3:
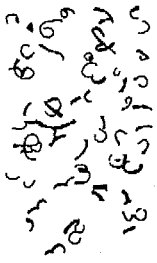
Figure 3:
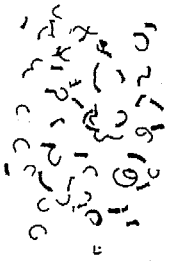
Figure 3:
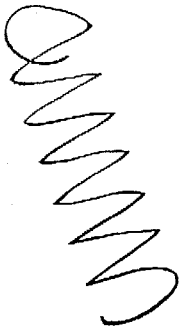
Figure 3:
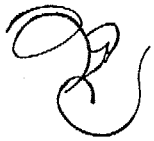
Figure 3:
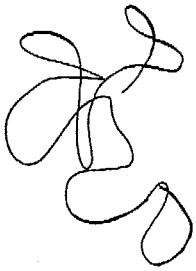

FIG. 3 shows the external conditions of chips.

From the results of Example 6 it has been confirmed that the alloy of the invention is excellent in machinability as compared with the invar and is considerably improved in work surface roughness as compared with the existing low thermal expansion cast irons.

I claim:

1. A low thermal expansion casting alloy of excellent machinability consisting essentially of, by weight percent, C greater than 0.5% to less than 0.8%, Si less than 1.0%, Mn less than 1.0%, Ni greater than 30.0% to less than 38.0%, Co from 2.0% to 8.0%, S less than 0.2%, P Less than 0.2% and one or both of Mg and Ca less than 0.3% in total, the Ni and Co contents being in a composition range given by the following formula $$Ni+Co\times 0.75=32.0 \text{ to } 40.0\%$$

the balance being iron containing unavoidable impurities, and that fine graphite is contained in the alloy structure, and the mean coefficient of thermal expansion is below $4\times 10^{-6}$/°C. between 20° C. and 100° C.

2. A low thermal expansion casting alloy of excellent machinability consisting essentially of, by weight percent, C greater than 0.5% to less than 0.8%, Si less than 1.0%, Mn less than 1.0%, Ni greater than 30.0% to less than 38%, Co 2.0% to 8.0%, S less than 0.2%, P less than 0.2% and one or both of Mg and Ca less than 0.3% in total, the Ni and Co contents being iron in a composition range given by the following formula $$Ni+Co\times 0.75=32.0 \text{ to } 40.0\%$$

the balance being iron containing unavoidable impurities, and in the fine graphite is contained in the alloy structure, and quench treatment is applied to said alloy after heating to a temperature of 600° to 1,000° C., and then quenched so as to obtain a mean coefficient of thermal expansion per 1° C. at $4\times 10^{-6}$ between 20° C. and 100° C.

3. A low thermal expansion casting alloy of excellent machinability consisting essentially of, by weight percent, C 0.6 to 1.4%, Si less than 1.0%, Ni 32.0 to 40.0%, S less than 0.2%, P less than 0.2% and one or both of Mg and Ca less than 0.3% in total, the C and Si contents being in a composition range given by the following formula $$C+Si\times 0.5<1.6\%$$

the balance being iron containing unavoidable impurities, and in that fine graphite is contained in the alloy structure, quench treatment is applied to said alloy after heating to a temperature of 600° to 1,000° C., and a mean coefficient of thermal expansion per 1° C. is below $4\times 10^{-6}$ between 20° C. and 100° C.

* * * * *